US006682601B1

(12) United States Patent
Beebe

(10) Patent No.: US 6,682,601 B1
(45) Date of Patent: Jan. 27, 2004

(54) ELECTRONIC FLUID DISPENSER

(75) Inventor: W. Scott Beebe, Ashland, MA (US)

(73) Assignee: Fishman Corporation, Hopkinton, MA (US)

( * ) Notice: Subject to any disclaimer, the term of this patent is extended or adjusted under 35 U.S.C. 154(b) by 0 days.

(21) Appl. No.: 09/701,953

(22) PCT Filed: Apr. 6, 2000

(86) PCT No.: PCT/US00/09177

§ 371 (c)(1),
(2), (4) Date: Apr. 25, 2001

(87) PCT Pub. No.: WO00/59643

PCT Pub. Date: Oct. 12, 2000

Related U.S. Application Data

(60) Provisional application No. 60/128,034, filed on Apr. 6, 1999.

(51) Int. Cl.[7] ..... B05C 11/00

(52) U.S. Cl. ..... 118/679; 118/697; 118/669

(58) Field of Search ..... 118/669, 697, 118/679, 668, 699–700, 703; 222/1

(56) References Cited

U.S. PATENT DOCUMENTS

| | | | | | |
|---|---|---|---|---|---|
| 4,572,103 | A | | 2/1986 | Engel | 118/697 |
| 4,904,499 | A | | 2/1990 | Shimizu | 427/207.1 |
| 4,986,443 | A | * | 1/1991 | Saur et al. | 222/1 |
| 5,110,615 | A | | 5/1992 | Maiorca et al. | 427/8 |
| 5,630,527 | A | * | 5/1997 | Beebe et al. | 222/1 |
| 5,747,102 | A | * | 5/1998 | Smith et al. | 427/96 |
| 5,765,722 | A | * | 6/1998 | Beebe et al. | 222/1 |
| 5,816,445 | A | | 10/1998 | Gardos et al. | 222/1 |
| 5,887,755 | A | * | 3/1999 | Hood, III | 222/135 |
| 5,932,012 | A | | 8/1999 | Ishida et al. | 118/669 |

* cited by examiner

*Primary Examiner*—Richard Crispino
*Assistant Examiner*—Y. T. Tadesse
(74) *Attorney, Agent, or Firm*—Cesari and McKenna, LLP; Edwin H. Paul, Esq.

(57) ABSTRACT

A programmable electronic fluid dispenser with computer controlled direct drives of a motor, connecting rod, and attached piston in a yringe is used to dispense accurate quantities of liquids with varying viscosities. The pistons are driven to dispense an amount and then the piston is reversed, overcoming any mechanical backlash, to prevent any leakage or oozing from the dispenser tip. A computer controls several dispensers cwith their outputs co-mingled. The desired proportions controlled by the computer driving the pistons.

7 Claims, 5 Drawing Sheets

ELECTRONIC FLUID DISPENSER

RELATED APPLICATIONS

Priority is claimed under 35 U.S.C. §119 (e) for the present invention from a provisional application, Serial No. 60/128,034, filed Apr. 6, 1999, of common inventorship, ownership and title.

FIELD OF THE INVENTION

The present invention relates to fluid dispensing systems and method of use thereof, primarily in industrial applications requiring the dispensing of fluids such as epoxies, silicones, adhesives, etc. More particularly the present application relates to those applications where preciseness and accuracy of the amount dispensed is important.

BACKGROUND OF THE INVENTION

Dispensing consistent, controllable, accurate measured amounts of fluids with varying viscosities at an assembly plant workstation is a long-standing problem facing manufacturers concerned with efficient precision product. As can be imagined, quality production requires that an optimum amount of fluid be consistently dispensed. Too little fluid and the product might be come apart and/or be unsafe to use as designed. Too much and the product might be unsightly, messy, or unsafe. Further, wasted fluid wastes money.

One prior art solution to this problem is to provide an applicator having a reservoir of fluid and attached to a driving force needed to extrude the fluid. These systems use syringes with air pressure driving the piston to expel the fluid.

Also known in the art is the use of syringe pumps that continuously introduce a fluid into an intravenous tube. These devices usually employ a gravity-fed tube attached to a reservoir (usually an intravenous bag or bottle) and a motor-driven pump that regulates the flow of fluid via a cam that alternately compresses and releases the tube. This technology lacks the precision requirements of industry.

More pertinent to the industrial context is the pneumatic pressure-driven fluid dispenser, which has a syringe containing the fluid to be dispensed attached to a controller that also controls a compressed air supply (usually "shop air"). Fluid is dispensed when the controller introduces the compressed air into the syringe that depresses the syringe piston a specific distance. A major disadvantage of this technology is that, as fluid is dispensed, an increasing void volume is created behind the syringe plunger. Thus, since the same volume of compressed air is introduced to the syringe behind the plunger regardless of the void volume of the syringe, there is substantial variability in the amount dispensed during successive operations of the syringe as the fluid is depleted in the syringe.

It has been recognized that mechanical control of a syringe plunger would increase the accuracy and consistency of fluid dispensing. U.S. Pat. No. 4,848,606 to Taguchi et al. shows an apparatus for dispensing a predetermined volume of paste-like fluid that has a motor attached to one end of a threaded screw rod and a nozzle holder functionally connected to the screw rod. To control the Z-axis position of the nozzle, the motor is operated, thereby rotating the screw rod and causing the nozzle holder to travel up and down the rod threads. The dispensing is accomplished by a second motor and screw rod combination, this time having a piston-driving device coupled to a piston that is disposed within the nozzle. Operation of the second motor rotates the second screw rod, causing axial movement of the piston and subsequent fluid dispensing from the nozzle.

One drawback of the Taguchi et al. device is that it uses an indirect mechanical coupling between the rotating motor and the piston or plunger of a dispenser. Another drawback is that it cannot be rack-mounted and put into a production assembly line system.

However, a fundamental drawback to the Taguchi et al. and similar devices is that they dispense fluid from a syringe by moving the syringe, not the plunger. Because these devices employ stepper motors, rotation of the rods attached thereto by definition results in axial movement of the means holding the syringe and, thus, the syringe itself, not of the rod and a plunger attached thereto. This is because stepper motors must be attached to the end of the rod that they drive, they do not allow the rod to pass through the axis of the motor such that the rod can move axially relative to the motor. Indeed, Taguchi et al. Make things more complex by requiring two stepper motors and two drive rods, one to control the axial position of the nozzle and one to dispense fluid.

Another major drawback of all these dispensers is that the "dosage" of fluid to be extruded cannot be controlled as precisely as desired. Most of the references use translated rotational motion to create relative linear movement of a plunger, whether by driving a plunger along the threaded member or using the threaded member to drive other mechanical plunger-driving means.

In contrast, use of a linear actuator instead of a stepper motor would allow the rod itself to be driven axially through the actuator thereby achieving direct control of a syringe plunger without complex mechanical means.

In addition to enabling precise volumetric control and ease of use, a practical fluid dispenser should be easily incorporated into an assembly line workstation.

Another limitation in prior art devices, especially dispensers of higher viscosity fluids, is that there is a residual dispensing, leakage or oozing of the fluid after the driving mechanism has stopped slowly expelling extra, unwanted fluid. To accommodate the time and this extra fluid, the dispensing apparatus cannot be moved to the next location since the leaking fluid would be drip onto unwanted areas as the dispenser was moved to the new location. A significant amount of time must pass before moving to allow the leaking to stop. This limitation prevents accuracy, precision and time efficient operation of the dispensing apparatus.

Another application of fluid dispensing requires mixing of components in precise and repeatable proportions. For example, even for the home workshop epoxy dispensers provide a dual syringe assembly with a single hand operated surface connected to the pistons located within the syringes. This allows for the simultaneous dispensing of the two components in rough proportions needed to adequately dispense the epoxy. This apparatus demonstrates an application of dispensing mixing fluids but this apparatus lacks the precision and repeatability required by industry. There is a need for accurate, precise proportional dispensing of fluids that commingle as they are dispensed.

A U.S. patent to Gardos et al. No. 5,816,445, discloses a two-part fluid dispenser with adjustable dispensing ratios. Air pressure drives pistons in cartridges whose linear motion is measured and controlled by a microprocessor or manually to dispense proper amounts. This system lacks accuracy and precision since the piston are not physically connected to and controlled from the microprocessor. The invention is directed towards fluids of differing viscosities. An air driven pinch tube controlled by the microprocessor closes the channel to the work piece thereby stopping the flow out of the system. Howevcer, this techniques does not fully prevent leaking. To provide some accuracy, the cartridges are pressurized and therefore need to be shrouded by to prevent distortion of the plastic cartridges during use. This system discloses using predefined and loaded cartridges to provide specific ratios of material delivered. The system drives the pistons in each cartridge the same distance, but the different cartridges will output different amounts as determined by the physical differences in the cartridges. This arrange is fixed, inflexible and limited in that other ratios can only be provided by replacing the cartridges, but the range of ratios is fixed by the availability of cartridges.

A U.S. patent to Weston, No. 5,348,585 discloses a controlled motor driven dispenser from a cartridge. There is a rotating drive rod that is mechanically interconned to move the piston in the cartridge. The arrangement shows that the motor and other parts of the mechanism move. This is a costly complexity and limitation of the invention. Moreover, the mechanism disclosed uses a rotating drive shaft and a threaded rod for effectuating the motion. Apparently form the patent the piston rotates which is another limitation of the design along with the complexity.

Another limitation of the prior art, mentioned above, is that it is desirable to eliminate dripping after a given amount of fluid has been dispensed. Occluding the output channel, as in the Gardos et al. patent discussed above, does not work well over the wide range of fluids and viscosities used in these system.

It is an object of the present invention to provide a solution for the above problems and limitations found in the prior art.

Accordingly, an object of the present invention is to provide a means for repetitively dispensing a precise and optimum amount of fluid.

A further object of the present invention is to provide a fluid dispensing means having sufficient rigidity, durability, and lightweight to meet production line requirements.

Another object of the present invention is to provide such a dispensing means that dispenses and commingles two or more fluids.

Still another object of the present invention is to provide a co-mingled output of two or more fluids in substantially any desired proportions.

Yet another object of the present invention is to provide a fluid dispensing means that drives a non-rotating rod that is interlocked and fixed to the piston within the syringe, thereby allowing the drive controller to reverse the direction of the piston.

Still yet another object of the present invention is to provide a dispensing process which eliminate dripping.

Yet another object of the present invention is to provide a system that uses preloaded syringes and cartridges wherein the contents therein never are exposed to the operating personnel.

Other objects, features and advantages of the present invention will be apparent from the following detailed description of the preferred embodiments thereof taken in conjunction with the accompanying drawings.

SUMMARY OF THE INVENTION

The present invention is a fluid dispensing system, and method of use thereof primarily in industrial applications requiring an accurate, precise dispensing of fluids with varying viscosities, such as water, epoxies, silicones, adhesives, solder paste, single component, two component, filled, premixed, frozen, etc.

The dispenser has a syringe disposed within an adapter unit that is attached to an dispenser apparatus. This apparatus is controlled by a microprocessor-based controller that can be programmed to dispense precise volumes of fluids based on syringe size, including length, inside diameter, dispense volume, dispense rate, backoff (see below), method of dispensing, and control of automated or manual dispense actions, and fluid viscosity.

An important advantage of the present invention is the linear driving of the piston in the syringe without rotating that piston. In the present invention the piston is fixed to the drive shaft and the arrangement linearly drives the piston without rotating by use, in a preferred embodiment, of a linear actuator.

Another feature of the present invention is reversing the motion of the piston to achieve "backoff." This feature is enhanced by controlling the timing of the "backoff" where the dispensing is stopped for a programmable length of time before reversing direction. As described above, for many fluids being dispensed unwanted leaking will occur. The present mechanism fixes the drive piston to the drive rod wherein the controller may drive the piston forward a precise distance dispensing fluid and then drive the piston backwards a precise distance to prevent any leakage. In a preferred embodiment a trial and error approach has been found to be an efficient way to determine for any given fluid the amount of back off needed to achieve the precision and accuracy for any particular application. In a preferred embodiment any mechanical backlash, when changing directions of the piston, is compensated by the trial and error approach.

The dispenser can be mounted for operation commercially available X-Y-Z axis tables, wherein the volume of fluid dispensed can be programmed by the controller or regulated by an external source to maintain the desired volumes at the desired rates. The controller may be a separate assembly that is rack mounted nearby.

The system comprises an applicator capable of accommodating one, two or more syringes or cartridges and piston assemblies, with the controller attached by a control tether to an electronic control unit. The applicator is provided with a linear actuator that displaces a drive rod a specific distance in response to an electronic drive signal generated by the controller. The electronic drive signal is generated by the controller in response to receipt of an actuator signal generated by either the operator, as by a finger switch attached to a handheld applicator or a footpedal, or a pre-programmed input, such as a microprocessor. Displacement of the drive rod creates a positive pressure on a fluid contained in the syringe, thereby causing fluid extrusion from the syringe. As can be expected, because the drive rod is displaced a precise distance forward, stopped and then displaced in reverse, this system allows for very precise control of the volume of fluid extruded.

The present invention has an advantage that it provides a precise, optimum amount of fluid to be repetitively dispensed quickly resulting in efficient operation.

In a preferred embodiment, there may be multiple self-contained syringes or cartridges arranged with common outputs where the co-mingled proportions are programmable by the controller. These systems may be arranged in an automatic work station and may be powered from a battery or line power with the appropriate converters and interface electronic, as are well known in the field.

Further objects and advantages of the invention will become apparent from the description of the drawings and preferred embodiments of the invention, which follow.

DESCRIPTION OF THE PREFERRED EMBODIMENTS

Figure 1:
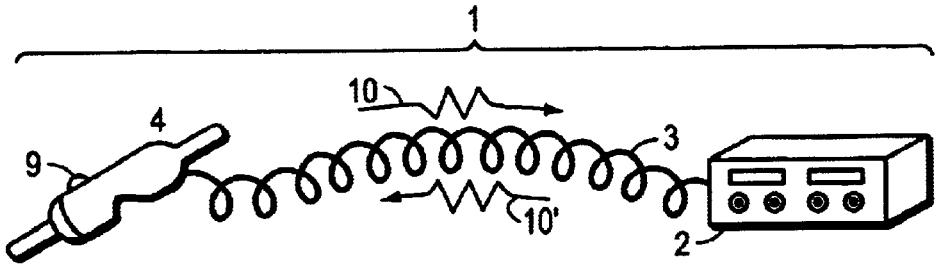
FIG. 1 is a schematic diagram of one embodiment of the electronically controlled fluid dispenser system presently claimed.
Figure 2:
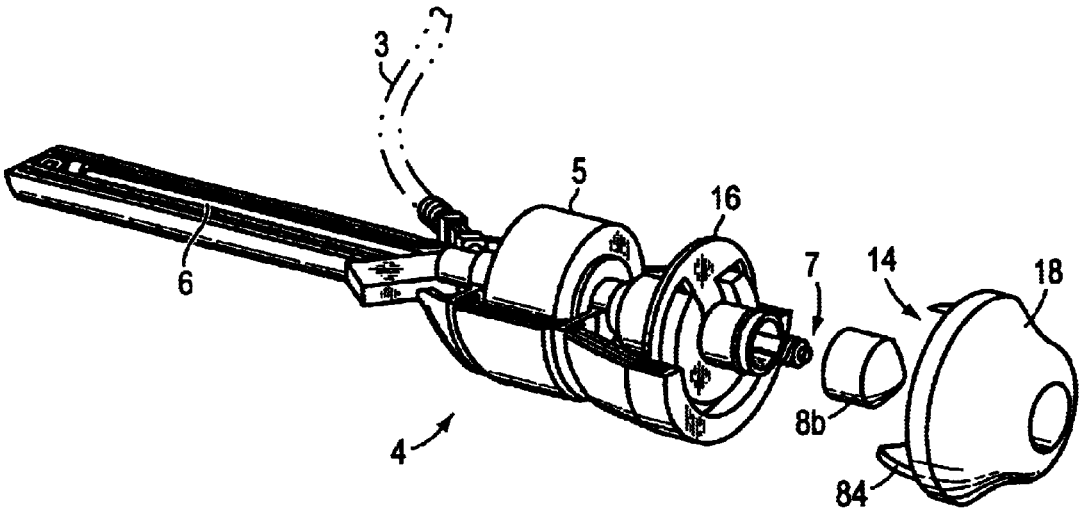
FIG. 2 shows a side view of one configuration of the ergonomically designed handheld applicator of the present invention.
Figure 3:
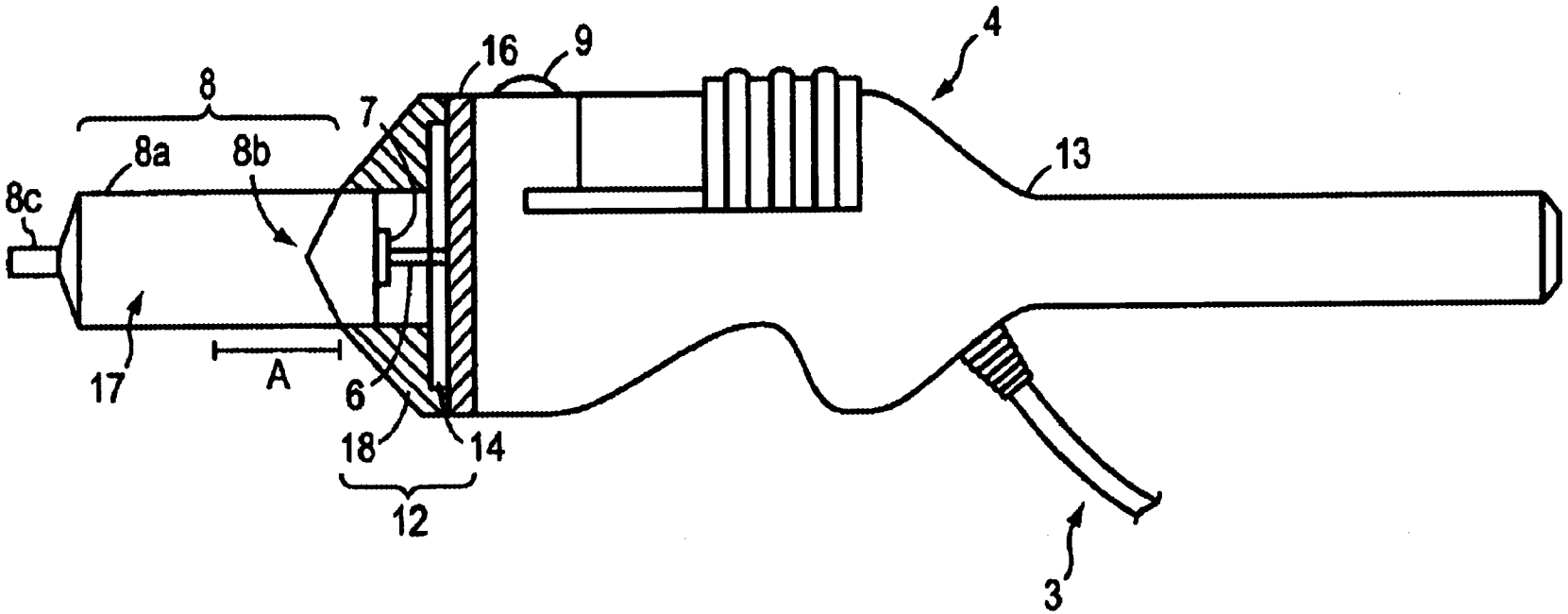
FIG. 3 shows the ergonomically designed handheld applicator of FIG. 2 in combination with a syringe and piston assembly.
Figure 4A:
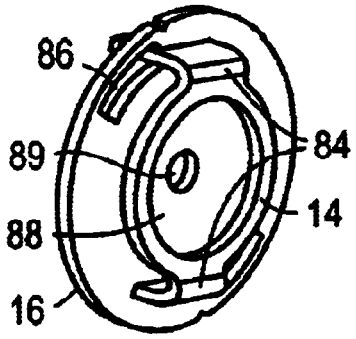
FIG. 4A shows a perspective view of one embodiment of the syringe adapter unit.
Figure 4B:
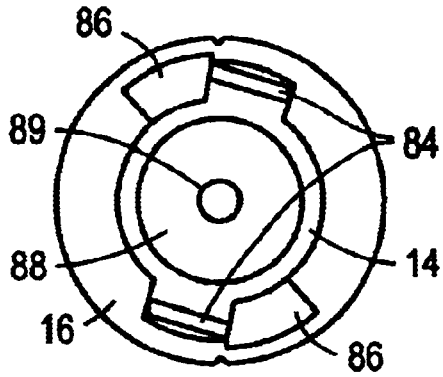
FIG. 4B shows a plan view of the embodiment of FIG. 4A.
Figure 4C:
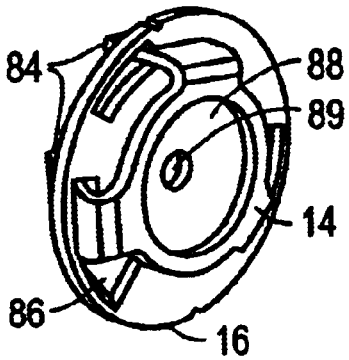
FIG. 4C shows a perspective view of a second embodiment of the syringe adapter unit.
Figure 4D:
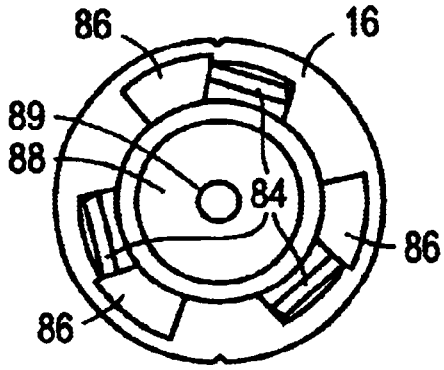
FIG. 4D shows a plan view of the embodiment of FIG. 4C.

An electronically controlled, positive-displacement fluid dispenser system is provided. The dispenser is primarily constructed of elements made from durable, lightweight materials. As shown in FIGS. 1, 2, and 3, the dispenser system 1 comprises a control unit 2 attached by a control tether 3 to an ergonomically designed handheld applicator 4, or to a mechanism fixed to a work station assembly line for automatic dispensing. See FIG. 6.

Figure 5:
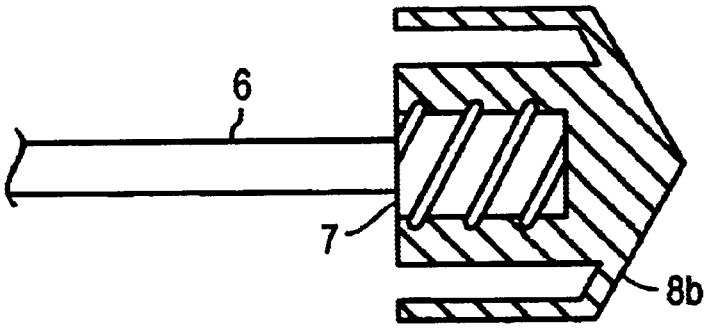
FIG. 5 shows one embodiment of the drive rod/plunger assembly.

The applicator 4 is provided with a linear actuator 5 having drive rod 6 axially and engagably disposed therethrough to an engagable terminus 7. Referring to FIG. 3, drive rod 6 inserts into a syringe 8*a* and piston 8*b* assembly for storage and application of the fluid 17 to be dispensed. Syringe 8*a* has a nozzle 8*c* adapted to accommodate applicator needles. Referring to FIG. 5, the engagable terminus 7 is designed to engage with piston 8*b*, so as to allow precise axial movement of piston 8b during both forward and backward movements.

Referring back to FIG. 3, the syringe 8 is securely combined with dispenser 4 by means of a retaining ring 14 and adapter plate 16. Referring to FIGS. 4A, 4B, 4C, and 4D, the retaining ring 14 has a plurality of locking tabs 84 disposed about the periphery of retaining ring 14 at a relatively normal angle from retaining ring 14. Retaining ring 14 further defines an axial void 88 capable of accommodating a syringe barrel. Adapter plate 16 is a planar member that defines a corresponding plurality of peripheral voids 86 capable of accommodating the plurality of locking tabs 84 such that rotation of retaining ring 14 relative to adapter plate 16 locks the tabs 84 into the voids 86. Adapter plate 16 further defines an axial void 89 suitable for accommodating drive rod 6. It is intended that adapter unit 12 be disposed within ergonomically designed cowling 18, although other constructions are possible, such as forming one face of retaining ring 14 into an ergonomically suitable shape.

Referring back to FIG. 1, control unit 2 may allow the dispenser operator to select either pre-programmed fluid volumes and flowrates or a variable volume and flowrate, as required. When the operator depresses finger switch 9 a signal 10 is sent via control tether 3 to the control unit 2, which processes the actuator signal 10 in accordance with the pre-selected fluid volume(s) and flowrate(s) and generates an electronic drive signal 10' of fixed duration, which is transmitted via control tether 3 to linear actuator 5. Linear actuator 5 then displaces drive rod 6 a specific axial distance A to extrude the precise volume of fluid 17 desired. It is important to note that, in this mode, the controller determines the time duration of the electronic drive signal 10' which is not affected by the length of time that the operator depresses finger switch 9.

In this embodiment, the time duration of drive signal 10' is calculated to cause drive rod 6 to be displaced a specified distance forward with a subsequent specific backoff distance to ensure that the desired, metered volume of fluid is extruded. In another preferred embodiment the operator may elect manual control, where the time duration of the fluid extrusion, is controlled by the duration that the operator actuates the finger switch 9. Fluid will then be extruded at the selected flowrate for as long as finger switch 9 is depressed. Thus, in either mode of operation, the volume of fluid dispensed is controlled by regulating the duration of drive signal 10'.

Figure 6:
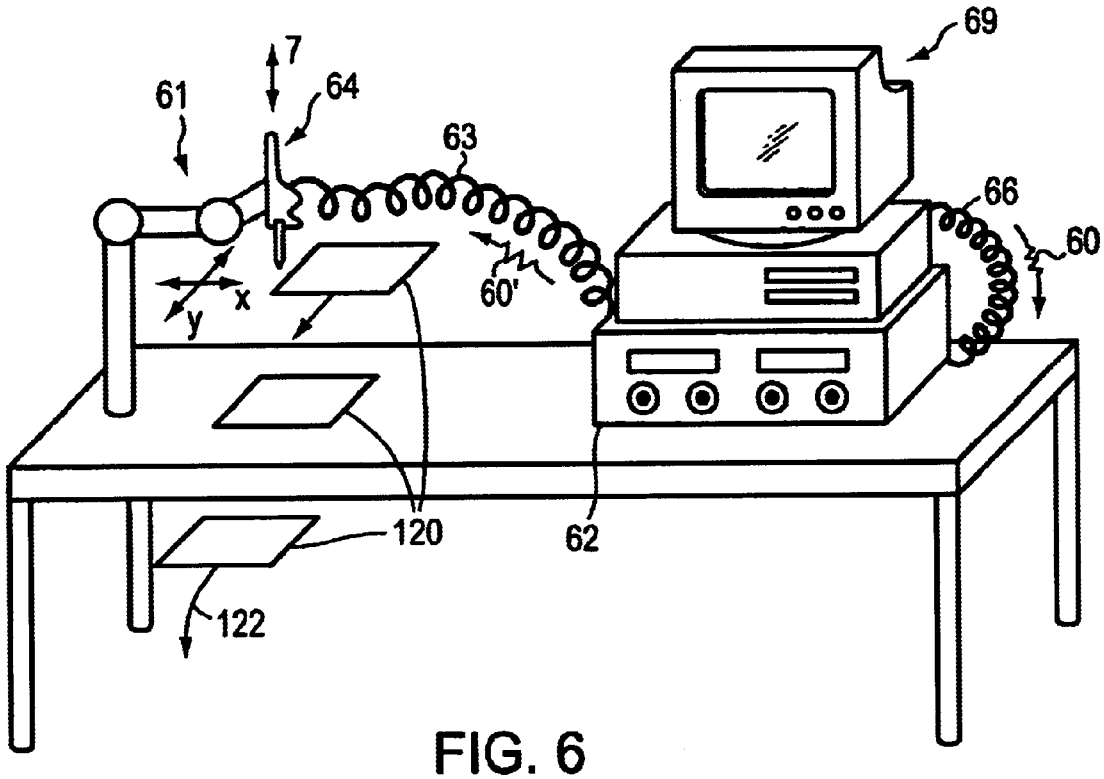
FIG. 6 shows the fluid dispenser system of the present invention integrated into an XYZ table, wherein the control unit receives input from a microprocessor.

Referring to FIG. 6, in a related embodiment, applicator 64 may be mounted on an XYZ table having a microprocessor capable of performing the functions of controller 62, such that applicator 64 is controlled directly by the XYZ table microprocessor via output tether 68. In an even further embodiment, the fluid dispenser system of the present invention may be combined with a XYZ table not having a microprocessor, such that controller 62 is the sole means of controlling fluid dispensing. The table may also be a workstation along an assembly line. Work pieces 120 are moved onto the table, and when the operation is concluded the piece is move off 122 and replaced by another. The dispenser 64 may be arranged and controlled for motion in an x, y and z direction to accommodate the operations. In another embodiment the table itself may move to position the work piece under the dispenser. In this case the dispenser needs only to move in the z direction.

Figure 7A:
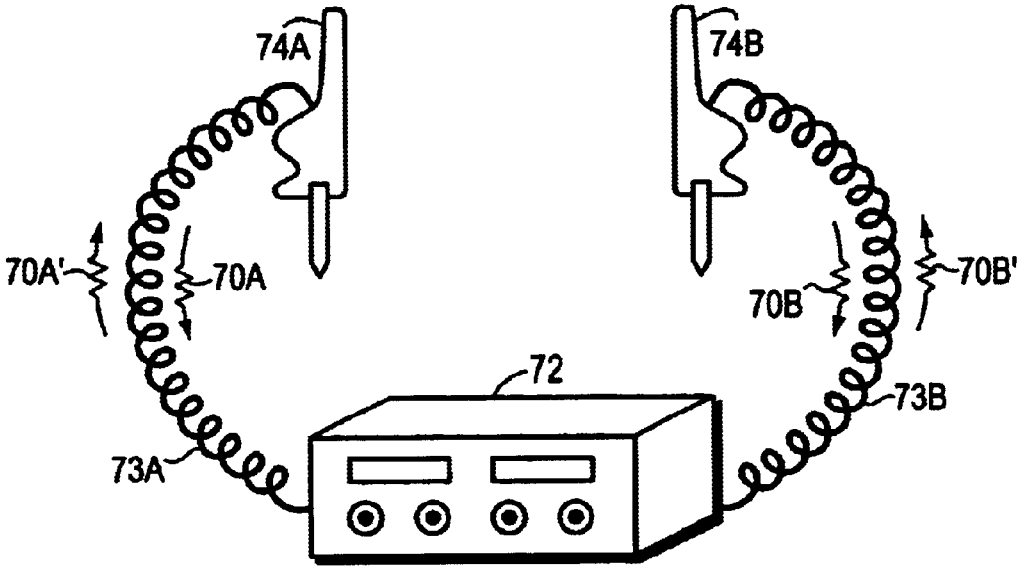
FIGS. 7A and 7B show an embodiment of the present invention wherein the control unit simultaneously controls two separate handheld applicators (7A) or fixed applications attached to an XYZ table; the two applicators with a commingled output.
Figure 7B:
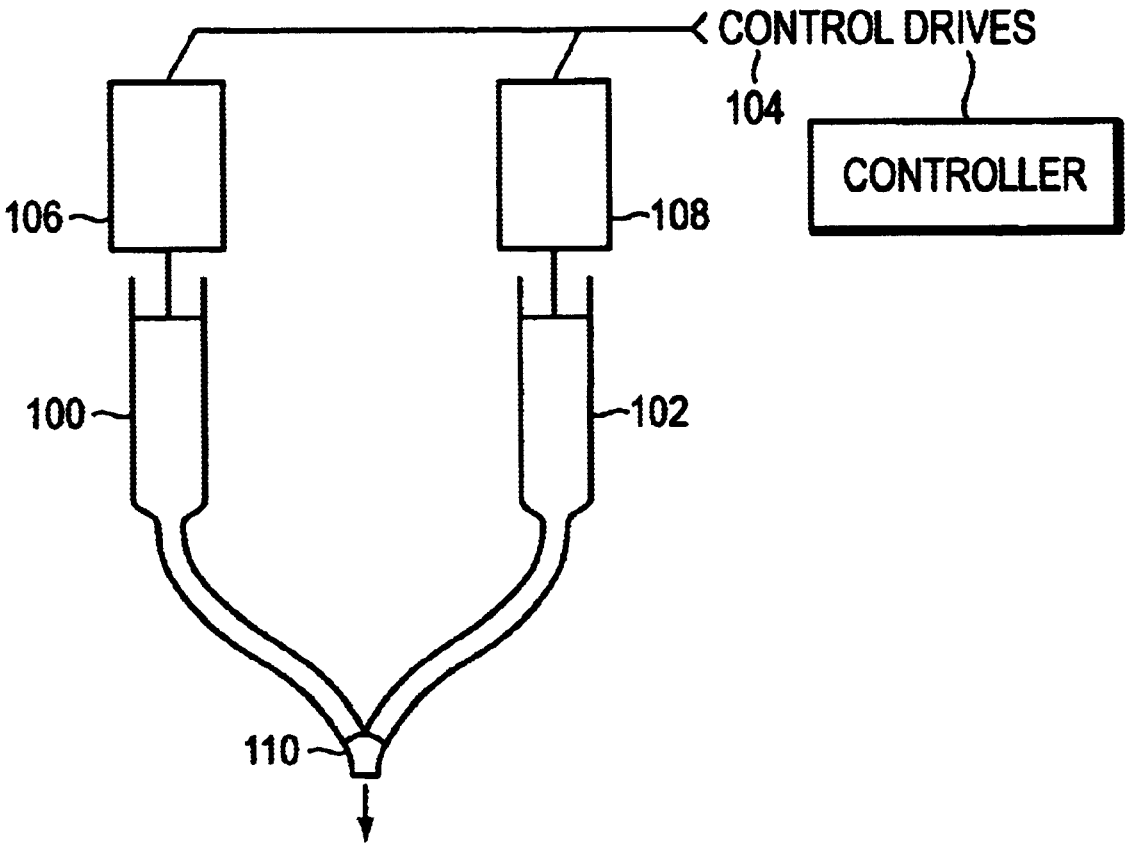

One further embodiment is shown in FIG. 7, wherein the controller 72 simultaneously controls two handheld applicators 74A and 74B via control tethers 73A and 73B. In this embodiment, control unit 72 is capable of (a) dual input of two separate actuator signals 70A and 70B from two separate applicators 74A and 74B, (b) dual signal processing in accordance with two separate pre-selected fluid volumes and two separate pre-selected flowrates, and (c) generation of two separate electronic drive signals 70A' and 70B' to the two separate applicators 74A and 74B. Thus, two operators simultaneously can each use separate applicators, or one operator can use two separate applicators either simultaneously or sequentially, as where bench-mixing of epoxy is desired. As shown in FIG. 7B which is a simplified drawing showing the operation, the two fluids 100 and 102 be commingled into a single output where the proportions of the two fluids may be controlled by actuators 106 and 108 which are driven 104 by programming in the controller. In each of these embodiments the backoff is used for each applicator and determined by trial and error methods. In FIG. 7B, valves 110 at the output orifice may be used to prevent the flow from one syringe from being drawn into the other output. Such valving is known in the art.

An important feature of the backoff discussed herein is that backoff is useful on all the various preferred embodiments including manual, mulitple, automatic and all the various combination thereof. In particular the present invention provides for a time controlled backoff. Many fluids, especially spongy types, like silicon, benefit from such a controlled backoff program. The implementation is that the forward thrust of the piston dispensing fluid is stopped when the programmed amount has been delivered amount, a delay time determined by trial and error occurs, and then the piston is reversed to draw the fluid up preventing dripping. This delay technique has been found to be more effective preventing dripping.

The arrangement of two syringes in FIG. 7B may be used in the automated system discussed above in FIG. 6, and more than two dispensers can be accommodated.

It is understood that these embodiments may be powered from a battery directly or from power cord that may draw power either from a power line/power supply or from a battery or storage device via (AC-to-DC, DC-to-DC, etc) power converter well known in the field.

The invention may be embodied in other specified forms without departing from the spirit or essential characteristics thereof. The present embodiments are therefore to be considered in all respects as illustrative and not restrictive, and all changes which come within the meaning and range or equivalency of the claims are therefore intended to be embraced therein.

What is claimed is:

1. A fluid dispensing system having an electronic controller constructed and programmed to activate and drive a piston to dispense a precise and accurate amount of fluid from an output, the fluid dispensing system comprising:

a motor and corresponding drive rod arranged wherein the drive rod moves relative to the motors, the drive rod defining an axis, means for activating the motor, means for attaching the drive rod to the piston such that the drive rod and the piston move as a unit together in the forward and reverse axial directions, means for producing a signal to activate the motor to drive the rod and piston axially to dispense a given quantity of fluid, means for stopping the motor for a delay time, and means for reversing the direction of the axial motion of the rod and piston to overcome backlash in the motor, rod and piston mechanism and to back off the piston thereby preventing leakage.

2. The system as defined in claim 1 further comprising one of more additional: motors, means to activate the additional motors, drive rods associated with the motors, a corresponding number of syringes and pistons wherein the pistons are fixedly attached to the drive rods, and means for co-mingling the outputs of all the syringes.

3. The system as defined in claim 2 wherein the controller comprises means for controlling the proportions of fluids delivered from each syringe to the co-mingled output by separately controlling the actuators for each syringe.

4. The system as defined in claim 2 wherein the syringes are self-contained syringes or cartridges containing the pistons and wherein the drive rods are fixedly attached to the pistons.

5. The system as defined in claim 1 wherein the controller provides means for controlling the time for the activation of the motor in both directions and the stoppage time.

6. The system as defined in claim 1 further comprising:

an XYX positioning system, wherein the controller is arranged to control the XYZ positioning system, and means for bringing a work piece under the out put of the dispensing system wherein fluid is dispensed, and means for replacing the work piece with another.

7. The system as defined in claim 1 further comprising a power unit that provides power to the system, wherein the power unit draws from a power line or from a battery.

* * * * *